US006352482B1

(12) United States Patent
Jacobson et al.

(10) Patent No.: US 6,352,482 B1
(45) Date of Patent: Mar. 5, 2002

(54) GOLF CLUB WITH HOSEL LINER

(75) Inventors: Daniel R. Jacobson, San Diego; Herbert Reyes, Laguna Nigel; Ronald K. Hettinger, Oceanside; J. Andrew Galloway, Escondido; Paul D. Zanolli, Valley Center; Andrew J. Goodjohn, Vista; Peter L. Soracco, Carlsbad; Edward J. Derian, San Diego, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/652,491

(22) Filed: Aug. 31, 2000

(51) Int. Cl.[7] ..... A63B 53/02
(52) U.S. Cl. ..... 473/310; 473/311; 473/345
(58) Field of Search ..... 473/305, 306, 473/309, 310, 311, 345, 308

(56) References Cited

U.S. PATENT DOCUMENTS

| | | | | |
|---|---|---|---|---|
| 1,658,581 | A | | 2/1928 | Tobia |
| 4,496,153 | A | | 1/1985 | Kochevar |
| 4,502,687 | A | | 3/1985 | Kochevar |
| 4,778,722 | A | | 10/1988 | Yamamura et al. |
| 4,793,616 | A | | 12/1988 | Fernandez |
| 4,874,171 | A | | 10/1989 | Ezaki et al. |
| 5,009,425 | A | | 4/1991 | Okumoto et al. |
| 5,093,162 | A | * | 3/1992 | Fenton |
| 5,190,290 | A | | 3/1993 | Take |
| 5,228,964 | A | | 7/1993 | Middleby |
| 5,242,168 | A | | 9/1993 | Aizawa |
| 5,262,118 | A | | 11/1993 | Fukushima et al. |
| 5,275,399 | A | * | 1/1994 | Schmidt |
| 5,350,556 | A | | 9/1994 | Abe et al. |
| 5,377,986 | A | | 1/1995 | Viollaz et al. |
| 5,395,109 | A | * | 3/1995 | Fenton |
| 5,429,365 | A | | 7/1995 | McKeighen |
| 5,452,890 | A | * | 9/1995 | Bingman |
| 5,485,998 | A | | 1/1996 | Kobayashi |
| 5,489,098 | A | | 2/1996 | Gojny et al. |
| 5,533,728 | A | | 7/1996 | Pehoshi et al. |
| 5,547,427 | A | | 8/1996 | Rigal et al. |
| 5,575,723 | A | * | 11/1996 | Take |
| 5,593,356 | A | | 1/1997 | Takeda |
| 5,672,120 | A | | 9/1997 | Ramirez et al. |
| 5,674,133 | A | | 10/1997 | Chang et al. |
| 5,779,560 | A | | 7/1998 | Buck et al. |
| 5,954,594 | A | * | 9/1999 | Uchiyama |
| 5,989,134 | A | | 11/1999 | Antonious |
| 6,102,813 | A | | 8/2000 | Dill |

* cited by examiner

*Primary Examiner*—Stephen Blau
(74) *Attorney, Agent, or Firm*—Michael A. Catania

(57) ABSTRACT

A golf club (20) with an internal hosel (38), a shaft (40) and a hosel liner (50) is disclosed herein. The hosel liner (50) reduces axial stress on the shaft (40) during impact of the golf club (20) with a golf ball. The hosel liner (50) is preferably composed of a polycarbonate material that has a flexural modulus in the range of 300,000 pounds per square inch to 1,000,000 pounds per square inch. Preferably, the golf club head (22) has a large volume, greater than 300 cubic centimeters, and weighs less than 215 grams. Preferably, the shaft (40) is composed of graphite and weighs between 40 grams to 80 grams.

13 Claims, 13 Drawing Sheets

GOLF CLUB WITH HOSEL LINER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a wood-type golf club. More specifically, the present invention relates to a large volume golf club with a hosel liner.

2. Description of the Related Art

The trend in the golf industry has been towards larger volume golf club heads in order to provide greater forgiveness to the typical golfer, the high handicap golfer. The trend began in the early 1990s with the stainless steel BIG BERTHA® driver from the Callaway Golf Company of Carlsbad, Calif. This was followed by the titanium GREAT BIG BERTHA® driver, also from the Callaway Golf Company, and then the 290 cubic centimeter ("cc"), titanium BIGGEST BIG BERTHA® driver, also from the Callaway Golf Company.

These large volume golf club heads have been matched with low weight shafts in order to lower the center of gravity of the golf club to provide a more forgiving golf club. As golf club heads become larger in volume, and shafts become lighter, the needs arises for reducing high stress regions to levels that shafts can withstand during golf club impact with a golf ball.

One example of the prior art is Chappell, U.S. Pat. No. 5,688,188 for a golf club. The Chappell patent discloses an iron with a ferrule composed of a thermoplastic material having a modulus of elasticity of 80–1980 pounds per square inch, a specific gravity of 1.15 to 1.22, shore hardness of 60, and an Izod strength of 3.0 to 10. Ft/lbs. The ferrule is placed within an external hosel, and the exposed end of the ferrule 21 millimeters. The preferred material is a butyrate.

Another example is Dekura, U.S. Pat. No. 5,766,089, which was originally filed in Japan in 1994 for a metal wood composed of magnesium or aluminum alloy with a hosel attaching section composed of ABS and epoxy. The rigidity of the hosel attaching section is lower than the shaft to absorb vibration and shock to thereby reduce vibrations through the shaft.

Another example is Allen, U.S. Pat. No. 5,888,149 which was originally filed in 1999 for a shortened hosel and an extended ferrule. The primary object of the Allen patent is to reduce hosel weight without sacrificing shaft support or cosmetic integrity. The Allen patent discloses a hosel with a length of 0.625 inch to 0.750 inch, and an extended ferrule composed of a high strength thermoplastic.

One of the earliest example is Offutt, U.S. Pat. No. 1,167,922, originally filed in 1914 for a golf club head with an enlargement on a tubular metal shaft to provide a fluted surface.

Yet others have used an insert for the ability to orient the shaft relative to the club. One example of such is Jackson, U.S. Pat. No. 5,839,973 for a Golf Club Head With Enlarged Hosel, originally filed in 1996. The insert of Jackson is removable thereby allowing for another insert with a different shaft orientation to be inserted into the hosel.

A further example of such an invention is Wood, et al., U.S. Pat. No. 5,851,155, which was originally filed in 1997. The Wood patent discloses a hosel that allows for customization of the face angle for a particular golfer by reorienting the club head relative to a neck member of the hosel.

Yet a further example is Kubica, U.S. Pat. No. 5,906,549 which was originally filed in 1997 for a golf club and a multitude of hosel with each hosel having a passage with a different angle relative to the club head. Each hosel has a flat portion for securing the hosel within a bore in the club head. The hosels are composed of a material softer than the club head.

BRIEF SUMMARY OF THE INVENTION

The present invention provides a solution to the reducing the stress on a shaft of golf club having a high performance, large volume golf club head. The present invention is specifically directed to reducing stress levels in high stress regions of a shaft for golf club heads with internal hosels.

One aspect of the present invention is a golf club including a golf club head, a shaft and a hosel liner. The golf club head has a crown, a sole, a striking plate, a heel end, a toe end and an internal hosel. The internal hosel has a crown opening and a sole opening. The golf club head preferably has a volume in excess of 300 cubic centimeters and weighs less than 215 grams. The hosel liner has an upper portion, a lower portion and a bore therethrough. The upper portion has a greater outside diameter than the lower portion, and lower portion is positioned within the internal hosel The hosel liner has a shoulder below the upper portion, which engages the crown. The hosel liner is composed of a polymer material. The shaft has a tip end and a butt end. The tip end of the shaft is positioned through the bore of the hosel liner and through the internal hosel to the sole opening. The shaft weighs less than 85 grams.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
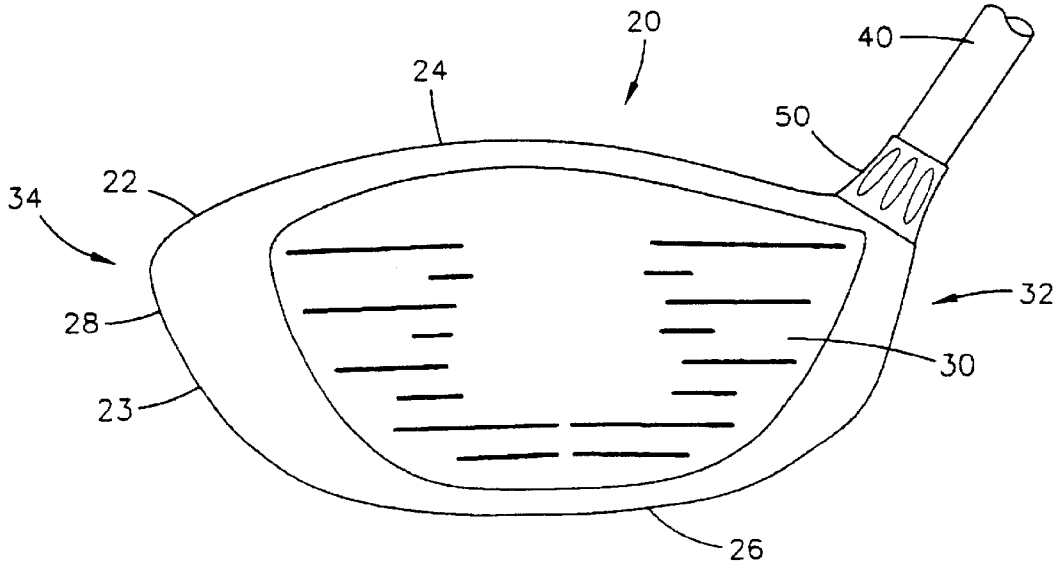
FIG. 1 is a front plan view of the golf club of the present invention.
Figure 2:
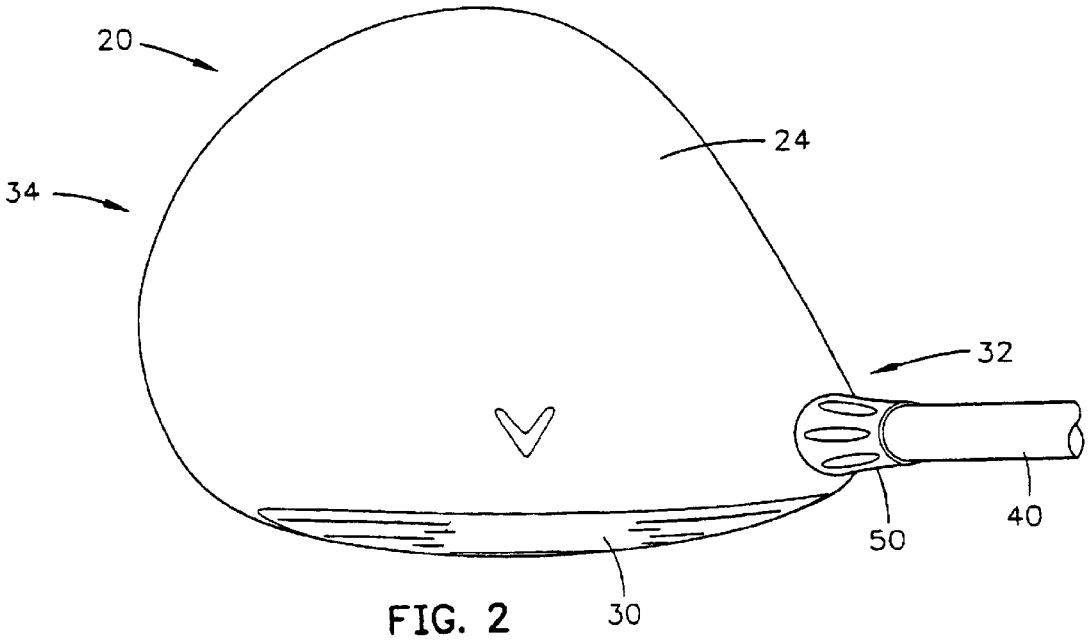
FIG. 2 is a top plan view of the golf club of FIG. 1.
Figure 3:
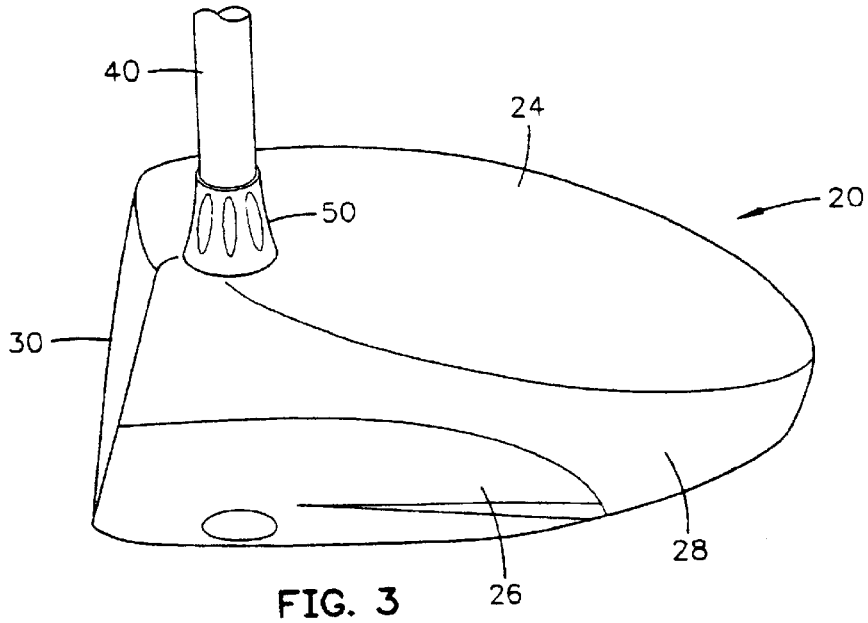
FIG. 3 is a heel end side view of the golf club of FIG. 1.
Figure 4:
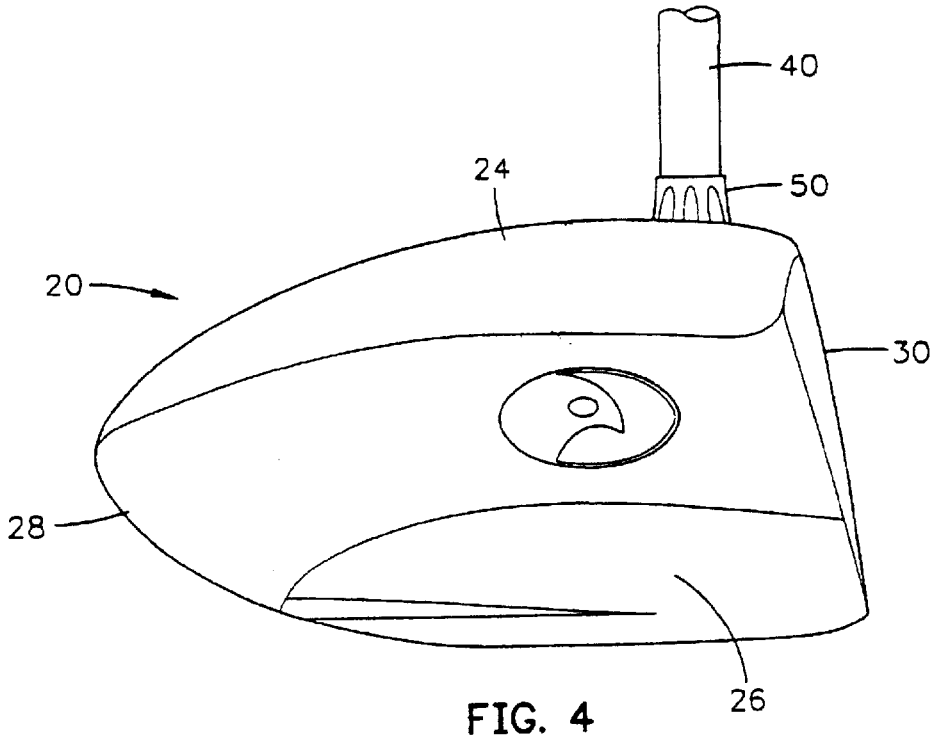
FIG. 4 is a toe end side view of the golf club of FIG. 1.
Figure 5:
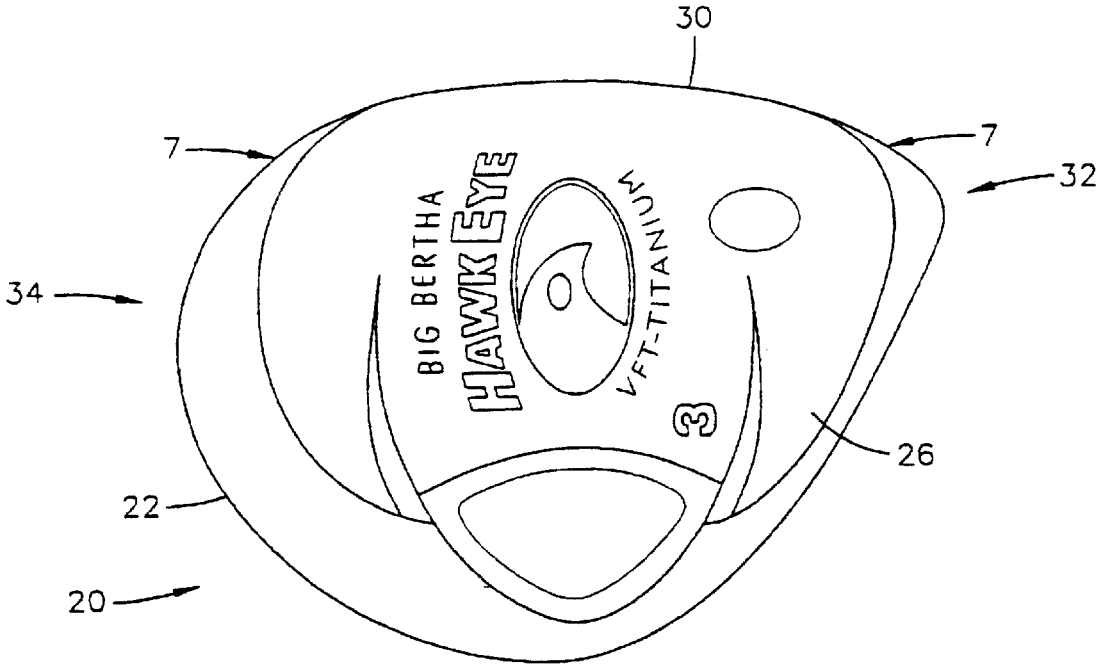
FIG. 5 is a bottom plan view of the golf club of FIG. 1.
Figure 6:
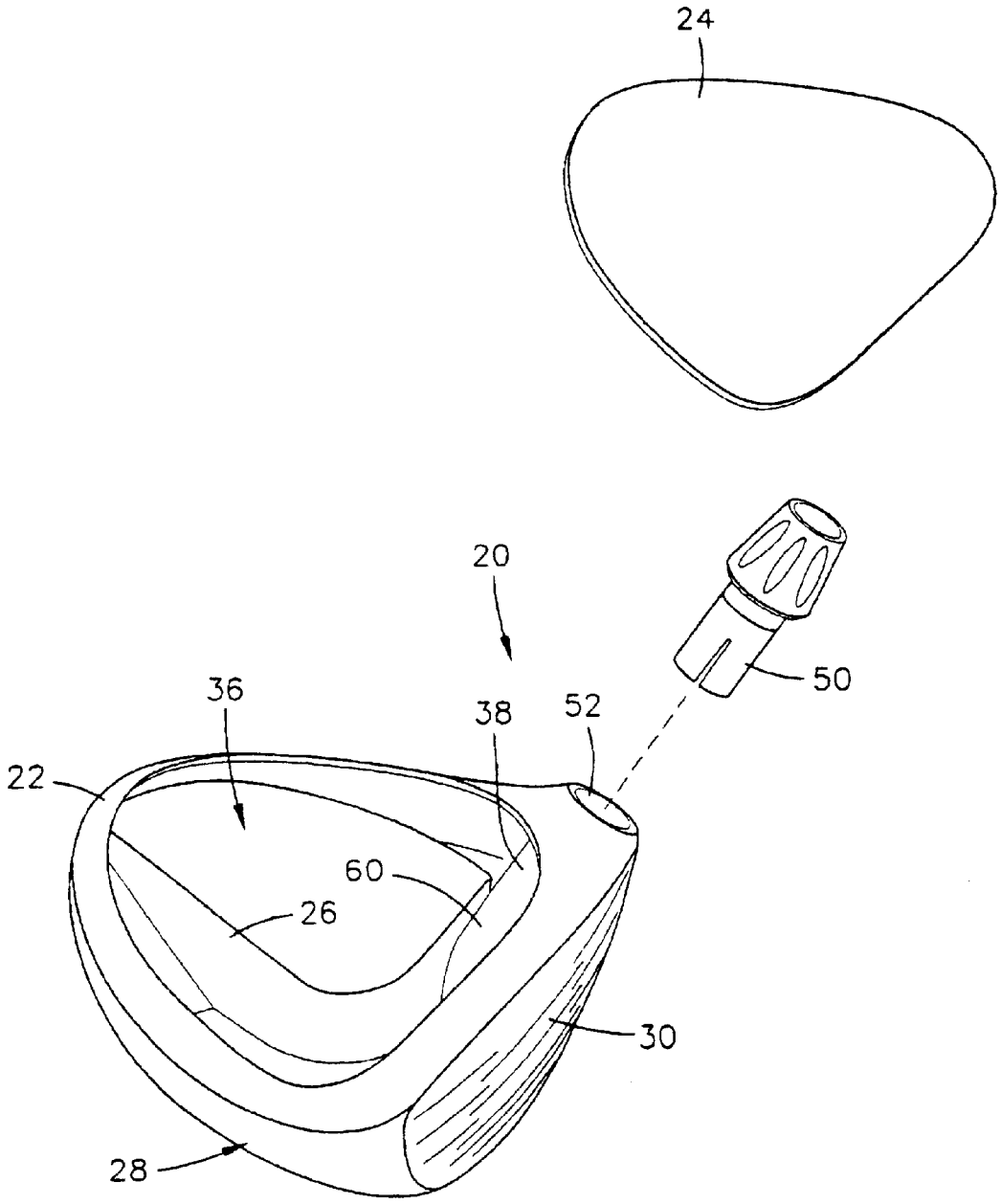
FIG. 6 is an exploded perspective view of the golf club of FIG. 1.

As shown in FIGS. 1–4, a golf club is generally designated 20. The golf club 20 has a golf club head 22, a shaft 40 and a hosel liner 50. The golf club head 22 has a body 23 with a crown 24, a sole 26, a ribbon 28 and a striking plate 30. The striking plate 30 generally extends from a heel end 32 to a toe end 34 of the front of the golf club head 20. The body 23 preferably has a hollow interior 36 with an internal hosel 38 for receiving the tip end of a shaft 40 through the hosel liner 50. The golf club head has a body 23 that is preferably composed of a metal material such as titanium, titanium alloy, stainless steel, or the like, and is most preferably composed of a forged titanium material. Such as a golf club head is disclosed in co-pending U.S. patent application Ser. No. 09/431,982, filed on Nov. 1, 1999, which is hereby incorporated by reference in its entirety. However, those skilled in the pertinent art will recognize that the body 23 may be composed of alternative materials such as composites.

The body 23 preferably has a large volume, most preferably greater than 300 cubic centimeters, and is most preferably 350 cubic centimeters. The body 23 preferably weighs no more than 215 grams, and most preferably weighs between 180 and 215 grams.

The shaft 40 is preferably composed of a graphite material, however, it may be composed of a lightweight metal material such as titanium. Alternatively, the shaft 40 may be composed of a hybrid of graphite and metal. Yet further, the shaft 40 may be composed of a thin stainless steel material. The weight of the shaft 40 preferably ranges from 40 grams to 80 grams, more preferably from 50 grams to 75 grams, and is most preferably 65 grams.

The shaft 40 is attached to the golf club head 22 through the hosel liner 50. The hosel liner 50 is positioned within the internal hosel 38 of the golf club head 22. The internal hosel 38 does not substantially extend beyond the top of the crown 24 of the golf club head 22. The hosel liner is placed through a top opening 52 in the internal hosel 38.

Figure 7:
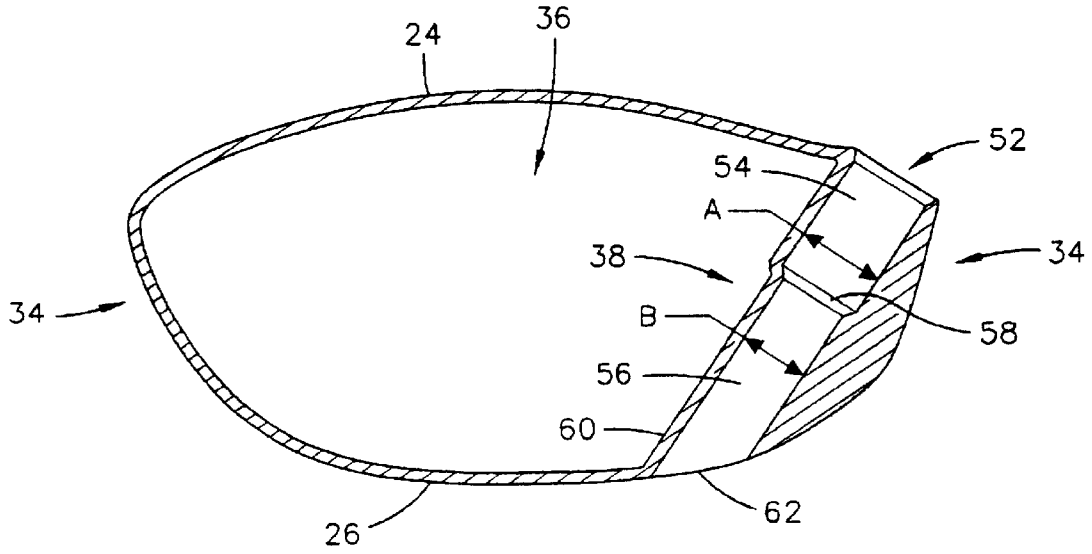
FIG. 7 is a cross-sectional view along lines 7—7 of FIG. 5.
Figure 8:
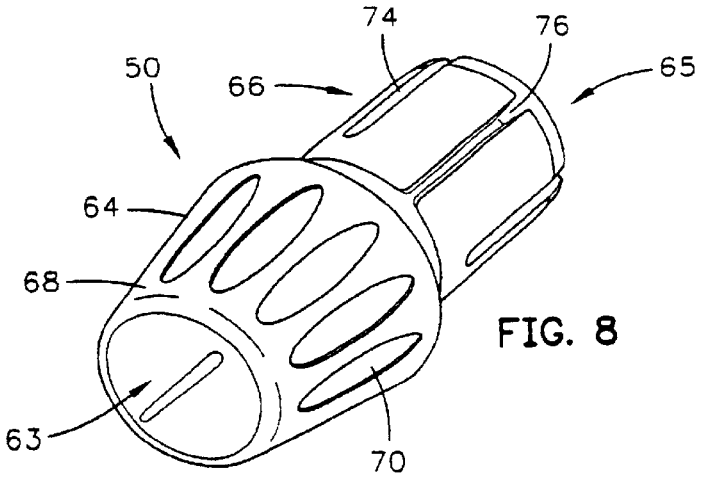
FIG. 8 is an isolated perspective view of the hosel liner of the golf club of the present invention.
Figure 9:
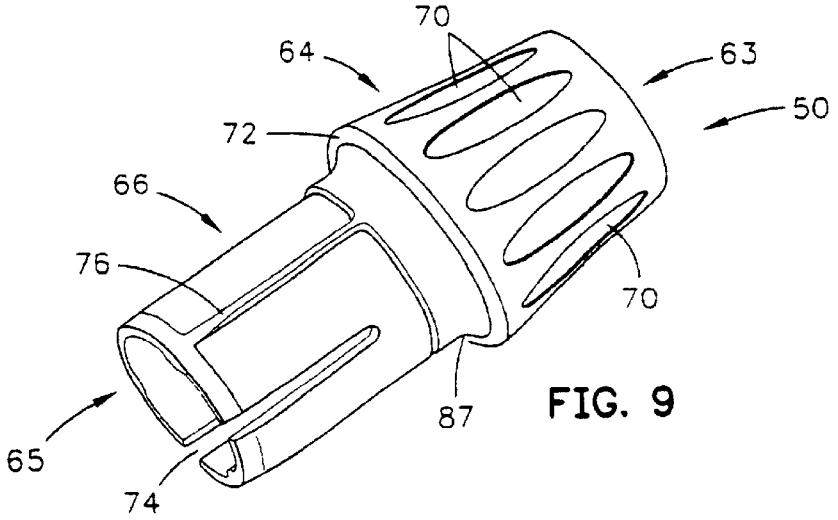
FIG. 9 is a reversed perspective view of the hosel liner of the FIG. 8.
Figure 10:
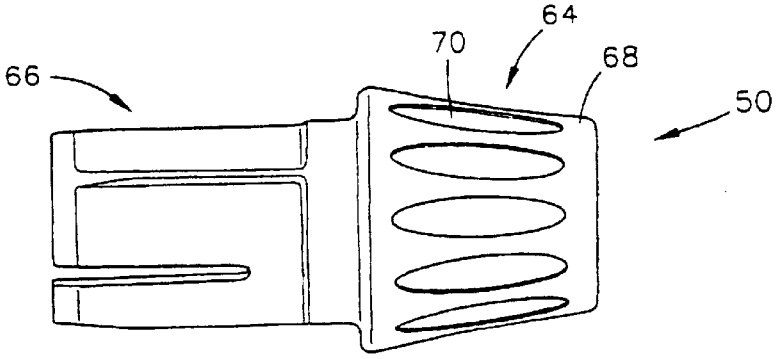
FIG. 10 is a side view of the hosel liner of FIG. 8.
Figure 11:
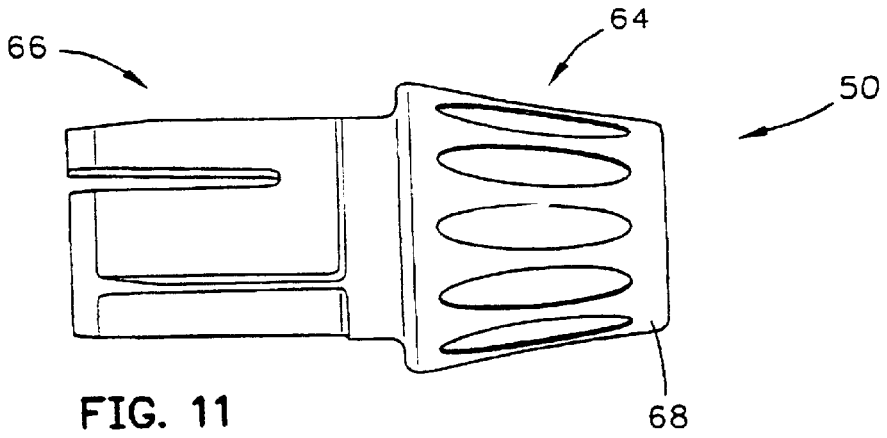
FIG. 11 is a quarter turn side view of the hosel liner of FIG. 10.
Figure 12:
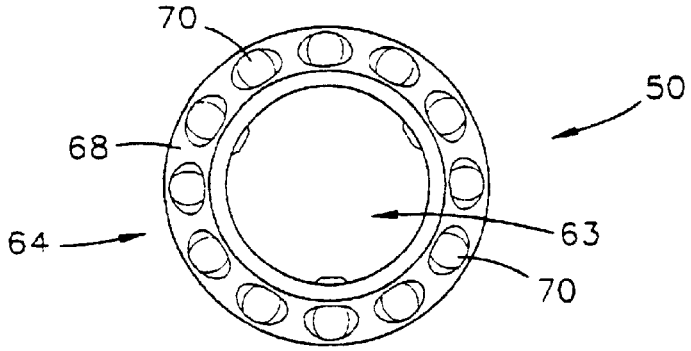
FIG. 12 is a top plan view of the hosel liner of FIG. 8.
Figure 13:
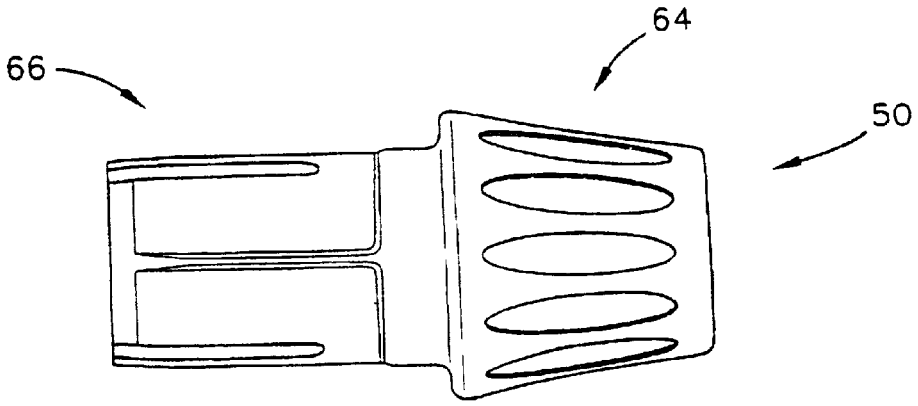
FIG. 13 is a half turn side view of the hosel liner of FIG. 10.
Figure 14:
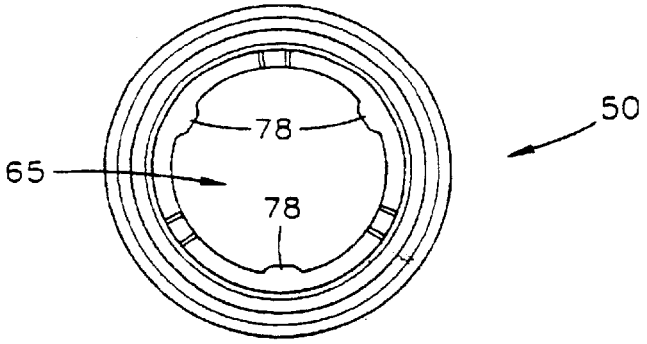
FIG. 14 is a bottom plan view of the hosel liner of FIG. 8.
Figure 15:
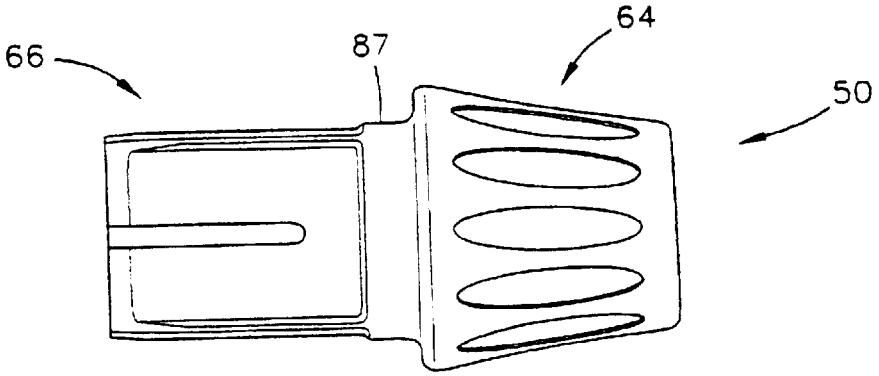
FIG. 15 is a three-quarter turn side view of the hosel liner of FIG. 10.
Figure 16:
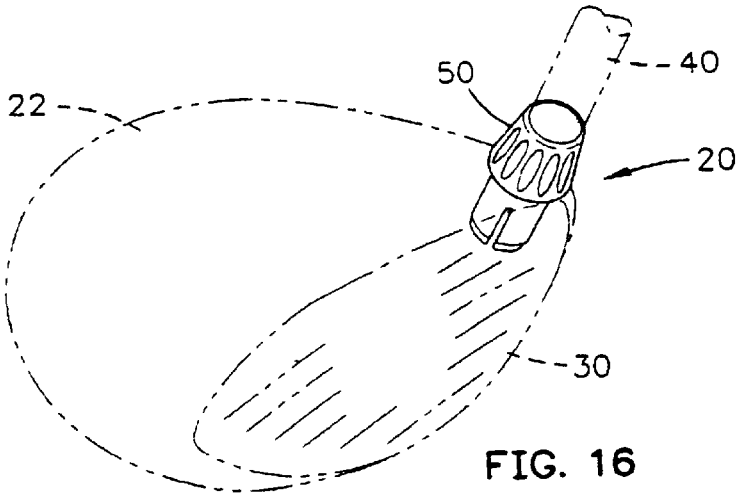
FIG. 16 is a perspective view of the hosel liner in a phantom of a golf club of the present invention.

As shown in FIG. 7, the internal hosel 38 has two chambers, an upper chamber 54 and a lower chamber 56. The upper chamber 54 has a diameter A and the lower chamber 56 has a diameter B. Diameter A is greater than diameter B in order to provide a mechanical locking mechanism for the hosel liner 50. In a preferred embodiment, the diameter A is approximately 0.437 inch and the diameter B is 0.364 inch. A transition 58 is juxtaposed by the upper chamber 54 and the lower chamber 56.

A wall 60 of the internal hosel 38 extends within the hollow interior 36 from the crown 24 to the sole 26. The internal hosel 38 preferably has a sole opening 62. The internal hosel 38 may be cast with the body 23 (except for the crown 24) of the golf club head 22 or the internal hosel 38 may be welded within hollow interior 36 if the body 23 is forged in separate components.

As shown in FIGS. 8–16, the hosel liner 50 generally includes an upper portion 64 and a lower portion 66. The hosel liner has an external opening 63 and an internal opening 65. The lower portion 66 is positioned within the upper chamber 54 of the internal hosel 38. The diameter A of the upper chamber 54 should securely accommodate the diameter of the lower portion 66. The diameter of the lower portion is approximately 0.420, however, the diameter of the external ribs 76 is approximately 0.437 inch. The diameter of a collar 87 is approximately 0.437 inch. The collar 87 further secures the hosel liner 50 within the internal hosel 38. The upper portion, at its greatest diameter (the shoulder 72), preferably has a diameter of 0.525 inch. The upper portion 64 rests above the crown 24. The upper portion 64 has an exterior surface 68 with a plurality of recesses 70 therein. The surface 68 of the upper portion is curved, and the outer diameter increases in size toward the lower portion 66. The upper portion 64 ends at the shoulder 72 that rests on the crown 24 of the golf club head 22 when the lower portion of the hosel liner 50 is placed within the internal hosel 38. The curved surface 68 of the upper portion 64 of the hosel liner 50 is discontinuous with the surface of the crown 24.

The lower portion 66 has a cylindrical surface 73 with slots 74 and external ribs 76. The slots 74 extend along a substantial portion of the surface 73 and are open at the internal opening 65. The interior surface of the lower portion 66 has projections 78 that engage the shaft 40. The hosel liner 50 is preferably composed of a polymer material such as a polycarbonate material. The hosel liner 50 is designed to relieve stress that is placed on the shaft 40 during the impact between a golf club head 22 impact and a golf ball. The hosel liner 50 prevents substantial contact between the shaft 40, typically graphite, and the metal golf club head 22. The polymer material used in the hosel liner 50 has an impact resistance of two to ten foot-pounds, and a flexural modulus of 350,000 pounds per square inch to 1,000,000 pounds per square inch. The thickness of the wall of the hosel liner 50 will vary according to the required flexural modulus. The wall thickness will increase as the modulus decreases, and the wall thickness will decrease as the modulus increases. A wall thickness of 0.035 inch will have a flexural modulus of 500,000 pounds per square inch.

Figure 17:
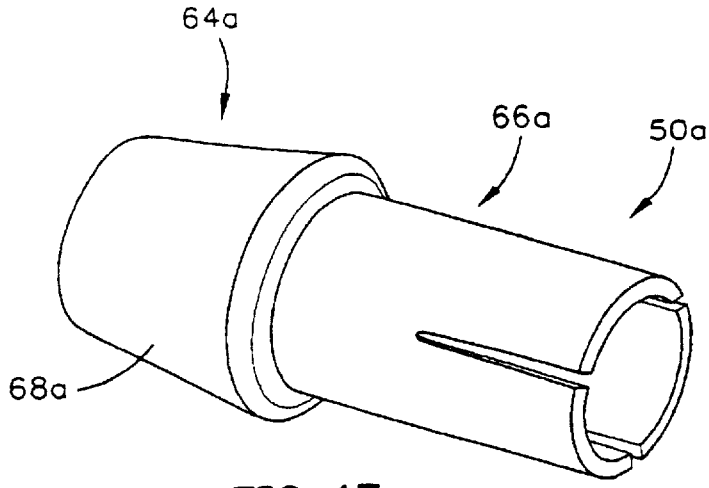
FIG. 17 is an alternative hosel liner of the golf club of the present invention.
Figure 18:
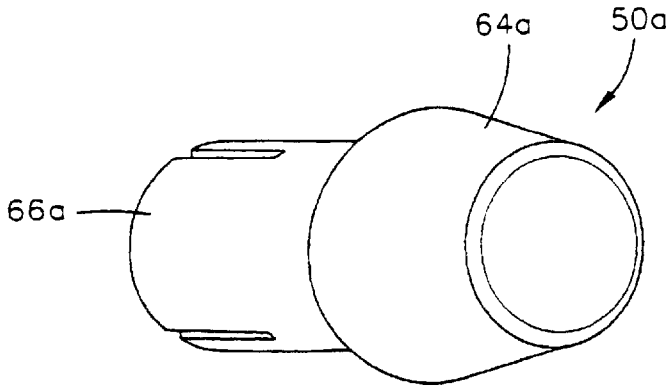
FIG. 18 is a reverse view of the hosel liner of FIG. 17.
Figure 19:
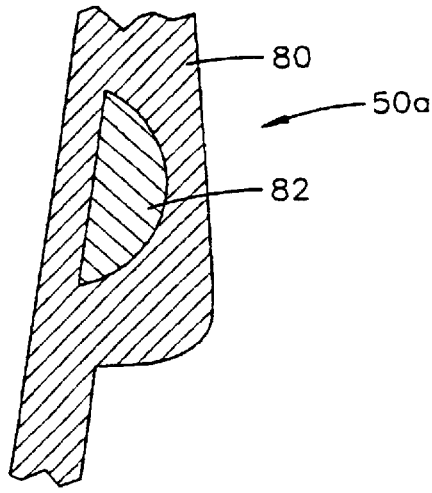
FIG. 19 is a cross-sectional view of the hosel liner of FIG. 17.

FIGS. 17–19 illustrate an alternative embodiment of the hosel liner 50*a*. The upper portion 64*a* of this embodiment has an entirely smooth surface 68*a*. The wall 80 of the hosel liner 70 may have a metal ring 82 embedded within for further stress reduction and support during impact with a golf ball.

Figure 20:
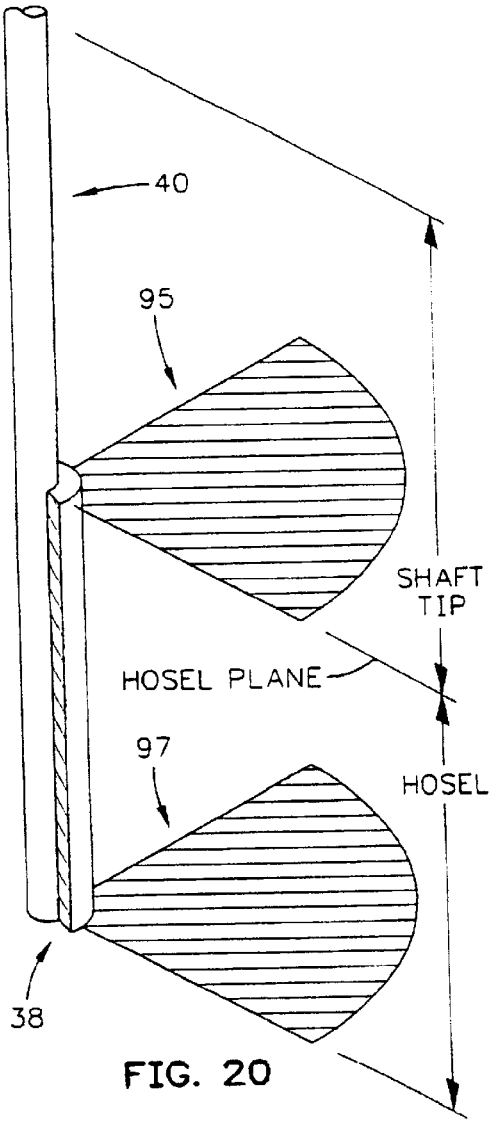
FIG. 20 is a computer image of an isolated shaft and hosel of a prior art golf club to demonstrate the axial stress regions.
Figure 21:
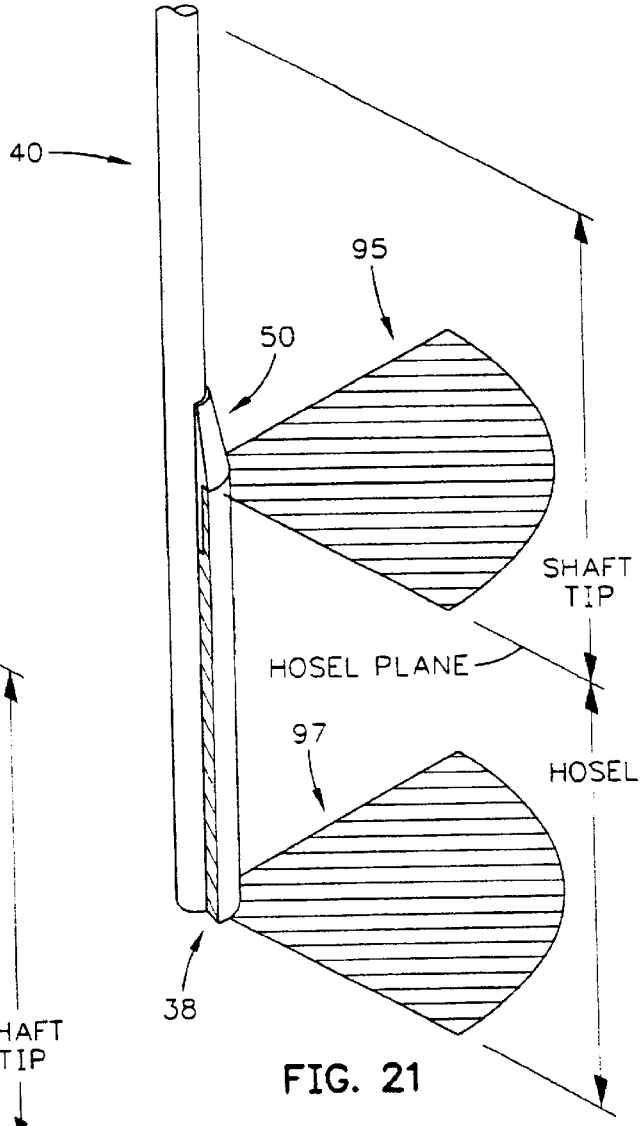
FIG. 21 is a computer image of an isolated shaft, hosel liner and hosel of the golf club of the present invention to demonstrate the axial stress regions.
Figure 22:
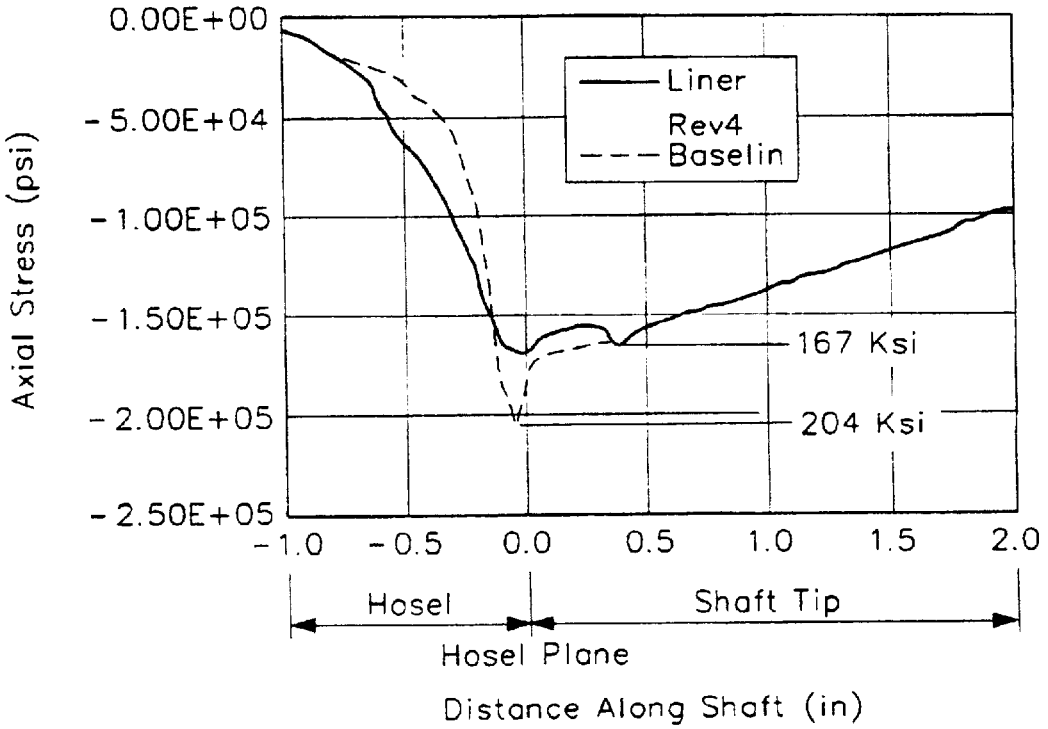
FIG. 22 is a graph of the axial stress versus location for the golf club heads of FIGS. 20 and 21.

FIG. 20 is computer generated image of the shaft 40 and hosel 38, without the hosel liner 50, to demonstrate the axial stresses that the shaft 40 and hosel 38 undergo during impact with a golf ball. FIG. 21 is computer generated image of the shaft 40, hosel 38 and hosel liner 50 to demonstrate the axial stresses that the shaft 40, hosel 38 and hosel liner 50 undergo during impact with a golf ball. FIG. 22 is a graph of the distance along the shaft 40 and the axial stress. The hosel plane 95 is where the shaft 40 enters the interior hosel 38 within the golf club head 22. The plane 97 is where the hosel 38 ends at the sole 26 of the golf club head 22. FIG. 22 shows a plot of the axial stress on the shaft 40 of FIG. 20 (no hosel liner 50) and the shaft 40 of FIG. 21. The axial stress plot of FIG. 21 is in bold and the axial stress plot of FIG. 20 is in dashed lines. The greatest axial stress is experienced at the hosel plane 95. The golf club head 22 without a hosel liner 50 undergoes an axial stress of 204,000 pounds per square inch ("psi"). The golf club head 22 with the hosel liner 50, the present invention, only undergoes an axial stress of 167,000 psi, 22% less than the non-hosel liner golf club head 22. Thus, the hosel liner 50 of the present invention reduces axial stress on the shaft 40, thereby prevent failure of the shaft 40.

Figure 23:
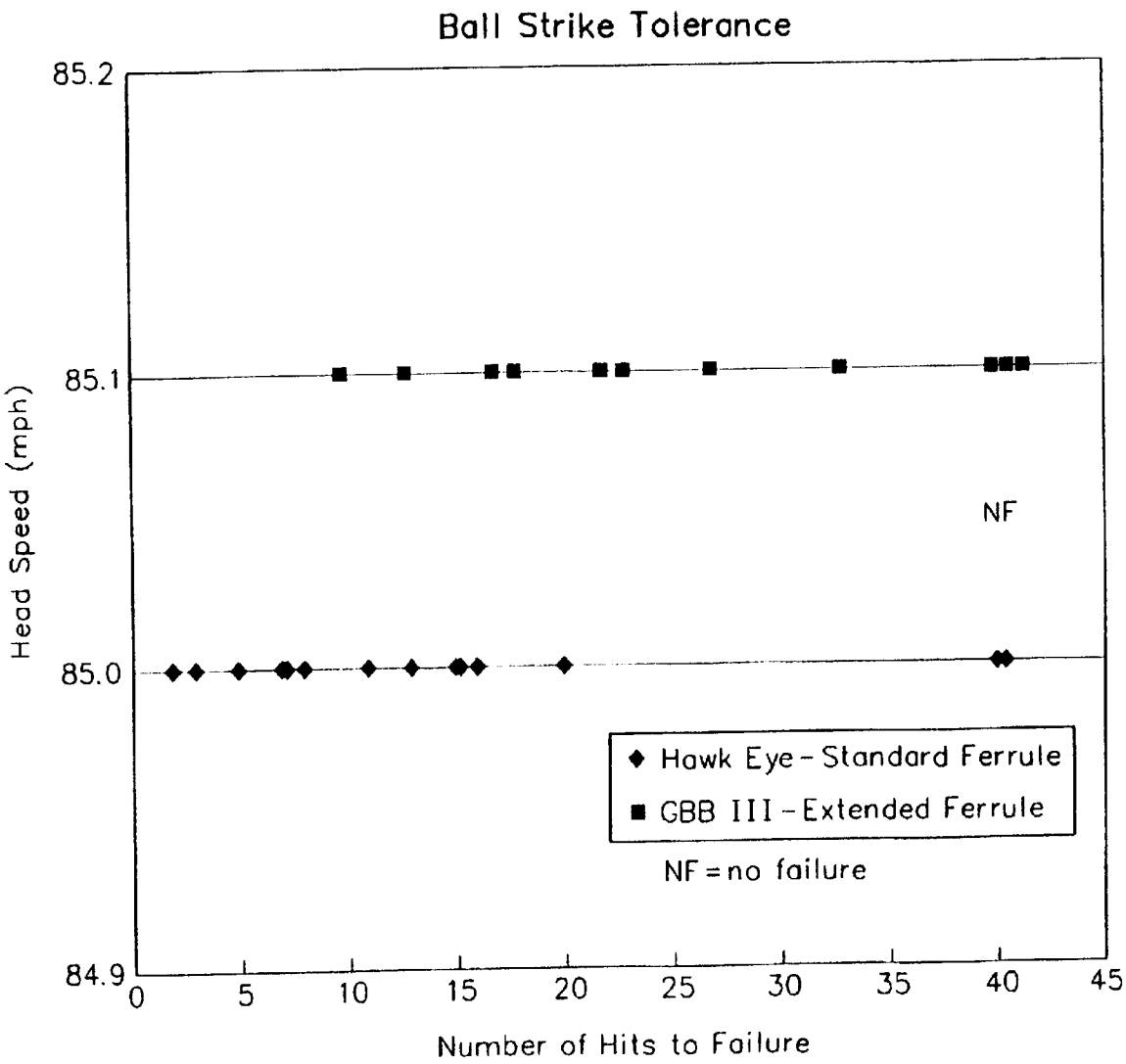
FIG. 23 is a graph of the ball strike tolerance of the golf club head of the present invention and a golf club head of the prior art.

FIG. 23 is a graph of head speed versus number of hits to failure. In this test, a golf was fired at the golf club head/shaft interface. The diamonds at 85 mile per hour ("MPH") represent golf clubs without a hosel liner 50, but having a volume and material composition similar to the golf club 20 of the present invention. The squares at 85.1 mph represent golf clubs 20 of the present invention. Each square or diamond represents a single golf club. The graph illustrates that the golf club of the present invention withstands impacts at the golf club head/shaft interface better than a golf club head without the hosel liner 50.

Figure 24:
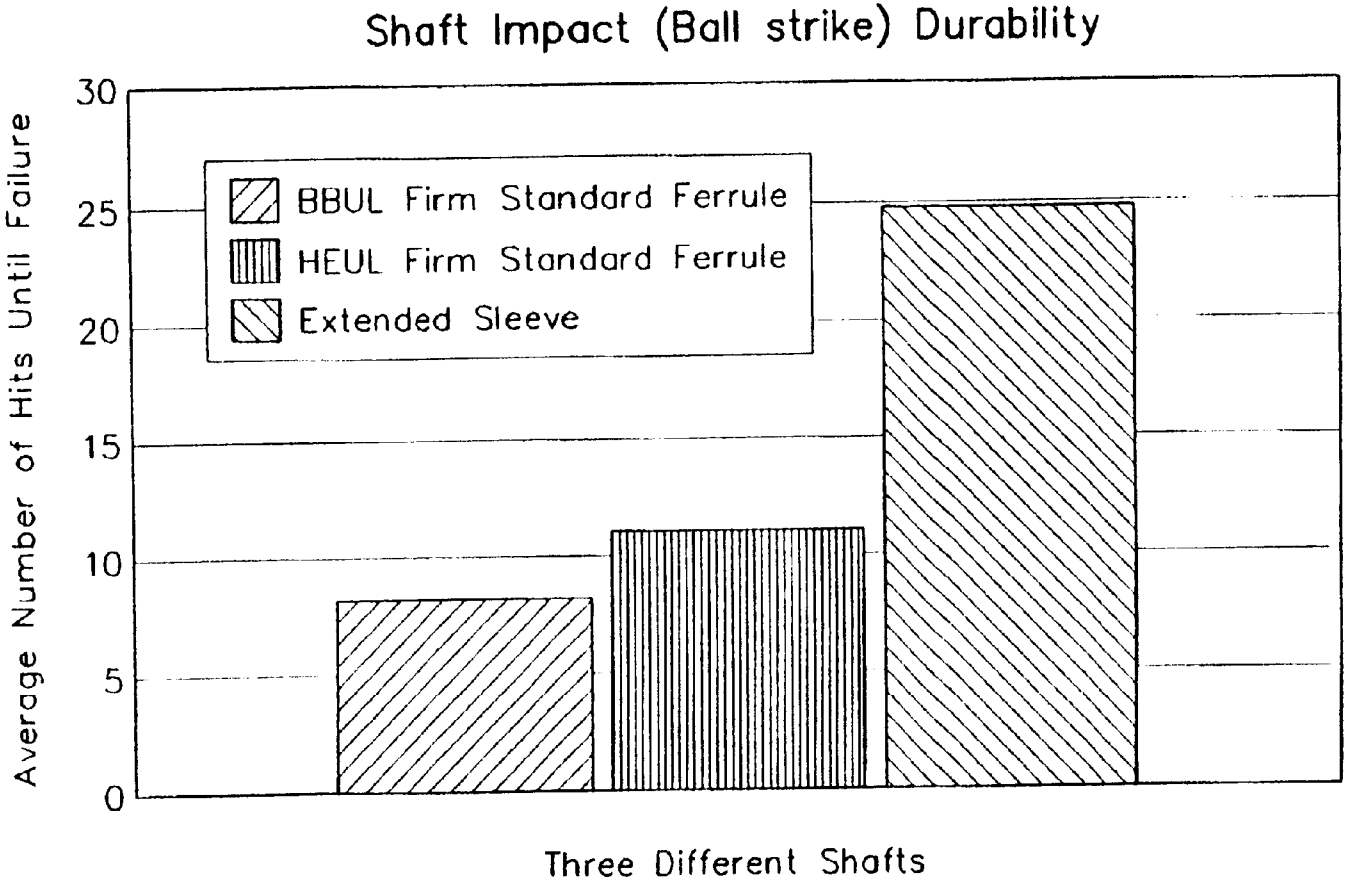
FIG. 24 is a graph of the shaft impact durability of the golf club of the present invention compared to golf club heads of the prior art using two different graphite shafts.

FIG. 24 is a graph of the number of hits until failure for two different graphite shaft types and the golf club 20 of the present invention. Similar to the above test, a golf ball was fired at the golf club head/shaft interface. The golf club 20 of the present invention withstood tow to three times the hits of other graphite shafted golf clubs. The reason the golf ball is fired at the golf club head/shaft interface is to replicate a miss-hit of the striking plate 30. Although, the probability of shots at the golf club head/shaft interface is very low, the golf club head/shaft interface is a point of weakness on the golf club and any strength improvement is desired. However, the improvement must not interfere with the performance of the golf club.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club comprising:

a golf club head having a crown, a sole, a striking plate, a heel end, a toe end and an internal hosel having a crown opening and a sole opening, the golf club head having a volume in excess of 300 cubic centimeters and weighing less than 215 grams;

a hosel liner having an upper portion, a lower portion and a bore therethrough, the upper portion having a concaved longitudinally curved surface with a plurality of recesses therein and a greater diameter than the lower portion, the lower portion positioned within the internal hosel, the hosel liner having a shoulder below the upper portion, the shoulder engaging the crown, and the hosel liner composed of a polymer material; and a shaft having a tip end and a butt end, the tip end shaft positioned through the bore of the hosel liner and through the internal hosel to the sole opening, the shaft weighing less than 85 grams.

2. The golf club according to claim 1 wherein the shaft is composed of a graphite material.

3. The golf club according to claim 1 wherein the golf club head is composed of titanium.

4. The golf club according to claim 1 wherein the internal hosel has an upper chamber and a lower chamber, the upper chamber having a diameter greater than the lower chamber, the lower portion of the hosel liner positioned within the upper chamber.

5. A golf club comprising:

a golf club head having a crown, a sole, a striking plate, a heel end, a toe end and an internal hosel having a crown opening and a sole opening, the golf club head having a volume in excess of 300 cubic centimeters and weighing less than 215 grams;

a hosel liner having an upper portion, a lower portion and a bore therethrough, the upper portion having a curved surface with a plurality of recesses and a greater diameter than the lower portion, the lower portion positioned within the internal hosel having a plurality of slots and a plurality of interior projections, the hosel liner having a shoulder below the upper portion, the shoulder engaging the crown, and the hosel liner composed of a polymer material; and a shaft having a tip end and a butt end, the tip end shaft positioned through the bore of the hosel liner and through the internal hosel to the sole opening, the shaft weighing less than 85 grams.

6. The golf club according to claim 1 wherein the golf club head is composed of stainless steel.

7. The golf club according to claim 1 wherein the golf club head has a volume greater than 315 cubic centimeters.

8. The golf club according to claim 1 wherein the golf club head weighs between 180 grams and 205 grams.

9. A golf club comprising;

golf club head having a crown, a sole, a striking plate, a heel end, a toe end and an internal hosel having a crown opening, a sole opening, an upper chamber and a lower chamber, the crown opening of the internal hosel disposed below the top of the crown, the golf club head having a volume in the range of 295 cubic centimeters to 350 cubic centimeters, and weighing between 175 grams and 215 grams;

a hosel liner having an upper portion, a lower portion and a bore therethrough, the upper portion having a concaved longitudinally curved surface with a plurality of recesses therein and a greater diameter than the lower portion, the lower portion positioned within the upper chamber of the internal hosel, the hosel liner having a shoulder below the upper portion, the shoulder engaging the crown, and the hosel liner composed of a polymer material; and a shaft having a tip end and a butt end, the tip end of the shaft positioned through the bore of the hosel liner and through the internal hosel to the sole opening, the shaft composed of a graphite material, the shaft weighing between 55 grams and 85 grams.

10. The golf club according to claim 9 wherein the lower portion of the hosel liner has a plurality of slots and a plurality of interior projections.

11. The golf club according to claim 9 wherein the golf club head is composed of stainless steel.

12. The golf club according to claim 9 wherein the golf club head is composed of titanium.

13. The golf club head according to claim 9 wherein the internal hosel has a transition region between the upper chamber and the lower chamber.

* * * * *